US005193321A

United States Patent [19]

Edwards

[11] Patent Number: 5,193,321

[45] Date of Patent: Mar. 16, 1993

[54] STANDING SEAM PANELING SYSTEM

[75] Inventor: Arthur O. Edwards, Edina, Minn.

[73] Assignee: Edco Products, Incorporated, Hopkins, Minn.

[21] Appl. No.: 817,080

[22] Filed: Jan. 6, 1992

[51] Int. Cl.[5] ..... E04C 3/00

[52] U.S. Cl. ..... 52/466; 52/520

[58] Field of Search ..... 52/460, 461, 462, 463, 52/464, 465, 466, 467, 468, 469, 470, 395, 584, 478, 520, 543, 716

[56] References Cited

U.S. PATENT DOCUMENTS

| | | | |
|---|---|---|---|
| 4,114,340 | 9/1978 | Dean et al. | 52/520 |
| 4,361,998 | 12/1982 | Ellison et al. | 52/463 X |
| 4,641,475 | 2/1987 | Berride | 52/466 X |

FOREIGN PATENT DOCUMENTS

| | | | |
|---|---|---|---|
| 2508519 | 12/1982 | France | 52/520 |
| 0038655 | 2/1990 | Japan | 52/464 |
| 817238 | 7/1959 | United Kingdom | 52/520 |

*Primary Examiner*—David A. Scherbel
*Assistant Examiner*—Creighton Smith
*Attorney, Agent, or Firm*—Burd, Bartz & Gutenkauf

[57] ABSTRACT

A standing seam paneling system comprising a plurality of elongated flat panels having upturned side edges arrayed in side-by-side relation on opposite sides of a series of longitudinally aligned spaced apart clips secured to a supporting surface. Each clip includes a generally rectangular upright body section having an integral flange-like foot section extending outwardly from its bottom edge for fastening the clip to the underlying support surface. The upper part of the clip includes a pair of angularly contoured members extending upward from a longitudinal row of perforations and adapted to be folded over in opposite directions over the upturned side edges of adjacent panels to secure them to the surface. A sealing cleat cap is installed over upturned panel edges and the retaining clips. When the paneling system is used as roofing, a pan dam is installed over the upturned uppermost end edge of each panel which is then inserted into a channel forming part of a roof cap extending along the ridge of the structure. An arrangement of dual roof caps may be used to provide ridge line venting of the structure.

10 Claims, 3 Drawing Sheets

STANDING SEAM PANELING SYSTEM

FIELD OF THE INVENTION

BACKGROUND OF THE INVENTION

This invention relates to an improved standing seam paneling system, including a clip for securing paneling to a supporting surface. While intended primarily for installation of roofing panels, the invention is equally applicable to the installation of vertical paneling as siding on the exteriors of structures.

THE PRIOR ART

Sagendorph U.S. Pat. No. 426,672, Spornhauen U.S. Pat. No. 877,133, Garvin U.S. Pat. No. 892,248, Hayman U.S. Pat. No. 1,693,274, Howarth U.S. Pat. No. 3,394,524, Wilson U.S. Pat. No. 3,982,373, Reinwall U.S. Pat. No. 3,998,019, Cotter U.S. Pat. No. 4,001,995, Vallee U.S. Pat. No. 4,014,152, Yoder U.S. Pat. No. 4,168,596, East U.S. Pat. No. 4,184,299, and Simpson U.S. Pat. No. 4,366,656 are exemplary of the many prior art patents directed to standing seam paneling and/or roofing systems.

SUMMARY OF THE INVENTION

Broadly stated the present invention comprises a clip for use in installing standing seam paneling which comprises a generally rectangular upright body section having an integral flange-like foot section extending outwardly from its bottom edge for fastening the clip to an underlying support surface. The upper part of the clip includes a pair of contoured members extending upward from a longitudinal row of perforations and adapted to be folded in opposite directions over the edges of adjacent panels having upright side edges to secure the same to the surface. The contoured members are also engageable with a sealing cleat cap to hold it in place over the seam between adjacent panels.

An installed standing seam paneling system comprises a plurality of such clips longitudinally aligned and secured to a supporting surface. Elongated flat panels having upturned side edges are arrayed in side-by-side relation on opposite sides of the aligned clips. The contoured upper members of the clip are bent in opposite directions down and over the upturned edges of the adjacent panels and a sealing cleat cap is installed over upturned panel edges and the retaining clips.

When the paneling system is used as roofing, a pan dam is installed over the upturned uppermost end edge of each panel which is then inserted into a channel forming part of a roof cap extending along the ridge of the structure. An arrangement of dual roof caps may be used to provide ridge line venting of the structure.

BRIEF DESCRIPTION OF THE DRAWINGS

The invention is illustrated by the accompanying drawings in which the same numerals are used to identify corresponding parts and in which.

DETAILED DESCRIPTION OF THE PREFERRED EMBODIMENT

Figure 1:
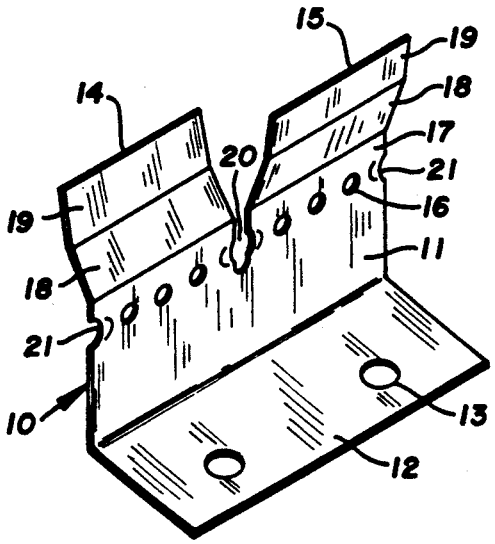
FIG. 1 is a perspective view of a clip according to the present invention adapted for nailing to a surface prior to installation of paneling.

Referring now to the drawings, and particularly to FIG. 1, there is shown a clip 10 for use in installing standing seam paneling which includes a generally rectangular upright body section 11 and an integral flange-like foot section 12 extending outwardly from the bottom edge of the upright section 11. Foot section 12 has one or more holes 13 to permit nailing of the clips to an underlying support surface. A pair of slightly longitudinally spaced apart angularly contoured members 14 and 15 extend upwardly from the upright body member 11 along a line of a plurality of perforations 16. The contoured members perform the dual function of holding adjacent panel members against the supporting surface and engaging a cleat cap over the standing seam as explained hereinafter.

Each of the members 14 and 15 includes a first section 17 coextensive with the body member 11 along the line of perforations 16, a second section 18 extending angularly outward and upward from the first section 17 on opposite sides of the body section, and a third section 19 extending angularly upward from the second section 18. Contoured member sections 18 are bent at an angle between about 40° and 50° relative to the upright body member 11 and first section 17 and the third sections 19 extend angularly upward from the second sections 18 at an angle between about 10° and 20° relative thereto. A slot 20 separates the contoured members 14 and 15. An indent 21 is provided at each end of the row of perforations 16 at the base of the contoured members 14 and 15. The concave side of each indent 21 is in the direction in which the members 14 and 15 are bent in use.

Figure 2:
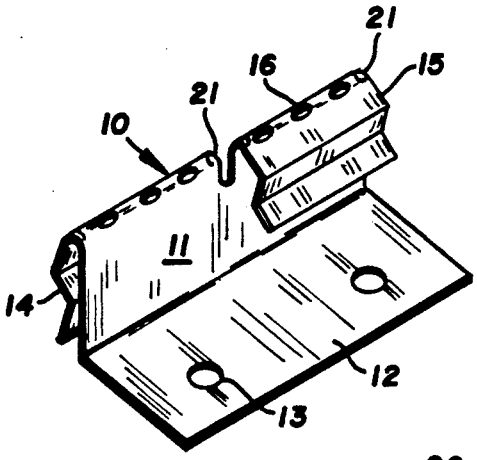
FIG. 2 is a similar view showing the upper contoured members of the clip bent in opposite directions to secure paneling in place.
Figure 3:
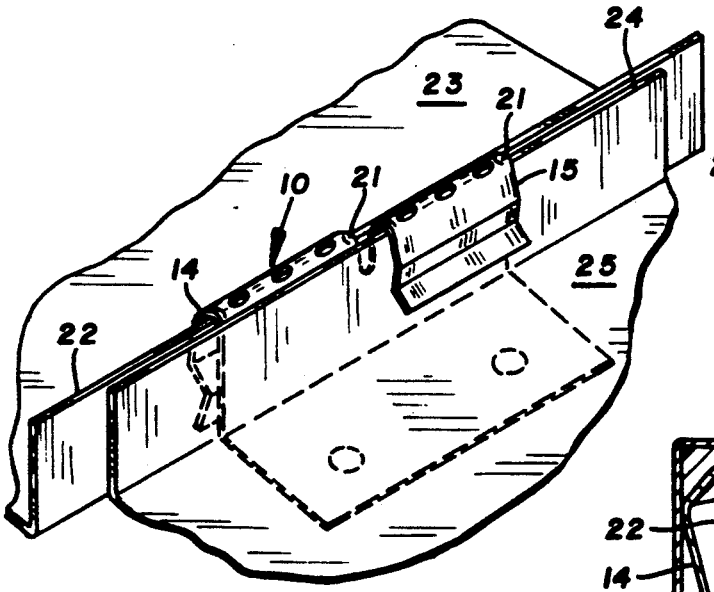
FIG. 3 is a similar view showing fragments of a pair of adjacent panels held by the clip.

As seen in FIG. 2, members 14 and 15 are adapted to be bent along the line of perforations 16 in opposite directions on opposite sides of the upright clip body section 11. As seen in FIG. 3, clip member 14 is bent down and over the upturned side edge or flange 22 of one panel 23 and member 15 is bent down and over the upturned side edge or flange 24 of a next adjacent panel 25. In use a plurality of spaced apart longitudinally aligned clips are first nailed or otherwise attached to a supporting surface, the panels are put into place with their upright side edges abutting the upright body member of each clip and the members 14 and 15 are bent over in opposite directions to hold the panels in place. The preformed clip enables precision bending in the field to facilitate precise attachment of an elongated molding strip in the form of a cleat cap indicated generally at 26.

Figure 4:
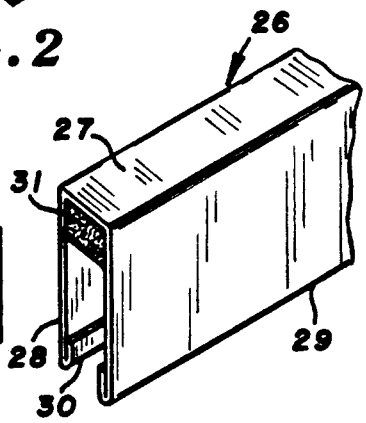
FIG. 4 is a perspective view of a cleat cap.

As seen in FIG. 4, the cleat cap 26 is generally U-shaped having a closed end 27 and generally parallel side walls 28 and 29. The edges of the parallel side walls 28 and 29 are turned inwardly to form lips 30 on opposite sides of the open end of the cap. A resilient compressible sealing material 31, preformed or formed in situ is provided in the inside closed end of the cap 26.

Figure 5:
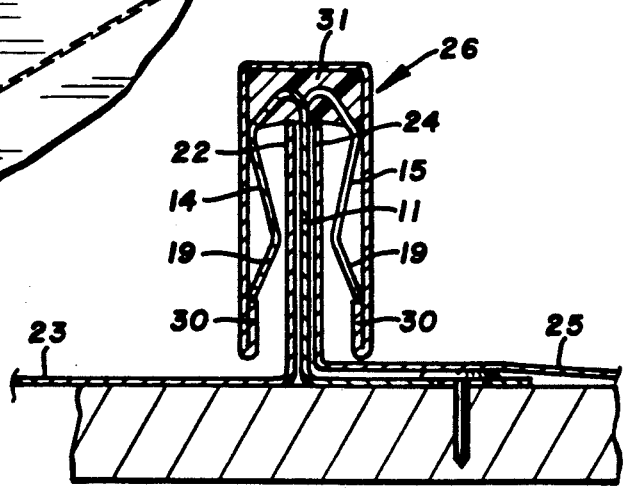
FIG. 5 is a sectional view, on a somewhat enlarged scale, showing a standing seam formed by a clip secured to a supporting surface, the upturned edges of a pair of adjacent panels and an overlying cleat cap having sealing material compressed against the tops of the clips and upturned panel edges.

As best seen in FIG. 5, when the molding cap 26 is put into place overlying the standing seam between adjacent panels 23 and 25 the sealant 31 is compressed against the tops of the clips and flanges of the panels to form a watertight connection. The molding is held precisely in place by virtue of the ends of clip sections 19 engaging the lips 30 on the inside edges of the cap sidewalls. The slight resiliency of the bent over clip members 14 and 15 urges the end sections 19 into firm gripping engagement with lips 30.

As is well understood in the art, clips 10 are formed from suitable steel or comparable metal. The panel members are likewise formed from sheet metal, usually aluminum or galvanized iron. The attachment of the panels with the clips of the present invention permit the panels to expand and contract without sticking or galling and resultant buckling of panels. Although the paneling system of the present invention is primarily intended for the installation of roofing panels, it is equally applicable to the installation of vertical siding.

Figure 6:
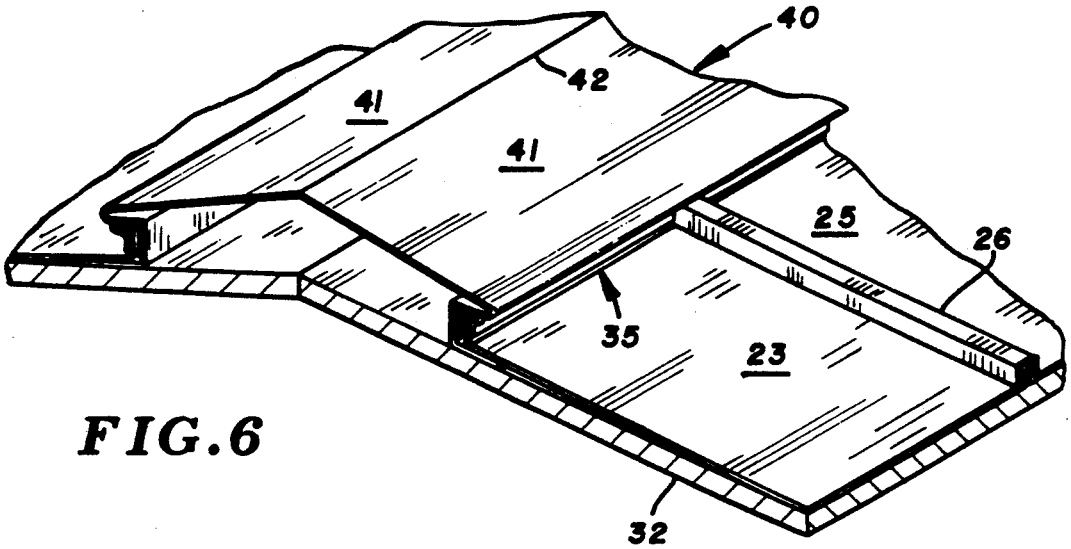
FIG. 6 is a fragmentary sectional view showing the paneling system in place as part of a roof.
Figure 7:
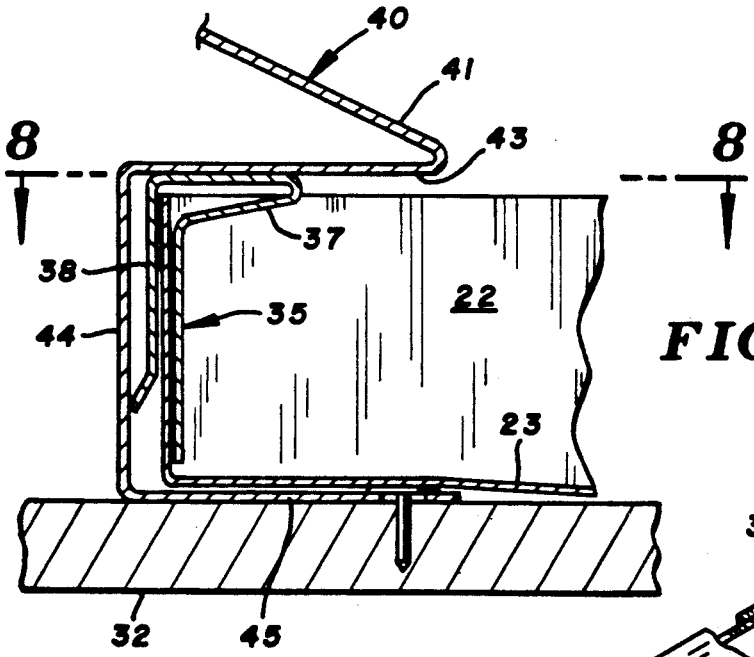
FIG. 7 is a fragmentary sectional view, on an enlarged scale, showing the uppermost end edge of a panel in engagement with a roof cap, but with the cleat cap removed for clarity.
Figure 8:
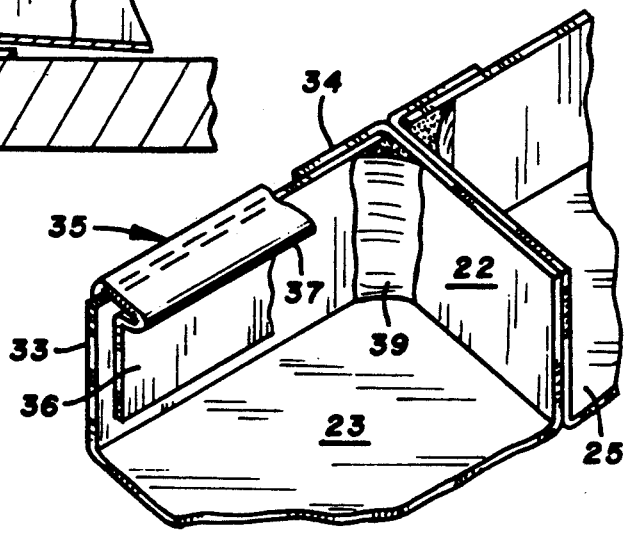
FIG. 8 is a perspective view generally on the line 8—8 of FIG. 7 and in the direction of the arrows, showing the top end structure of adjacent panels.

Referring now to FIGS. 6 through 8, the paneling system according to the present invention is shown in use as roofing. Two adjacent panels 23 and 25 are shown attached to roof sheathing 32 in the manner already described, the standing seam being covered by a cleat cap 26. As shown, the uppermost end edges 33 of the panels are turned upwardly at right angles from the panel face. At the same time the uppermost ends 34 of the panel flange 22 is bent inwardly against the outer face of the upturned panel end edge 33. These elements, upturned end edge 33 and inturned flange end 34, are held together by an elongated pan dam, indicated generally at 35, which snaps in place over the upward end of each panel and functions to further ensure the watertightness of the roof.

The length of pan dam 35 is approximately equal to the width of the panel between its upturned side edges. The pan dam 35 comprises a first portion 36 approximately equal in length and width to the upturned panel end edges 33 and in gripping engagement with one face of the upturned end edge. A second portion 37 of the pan dam projects outwardly from the top edge of the first section 36 projecting outwardly in the direction of the flat panel surface. A third portion 38 of the pan dam extends downwardly from the inward edge of the second portion 37 in engagement with the opposite face of the upturned panel end edge 33 and inwardly bent end 34 of the panel flange. The pan dam 35 is formed from metal and resiliently engages the uppermost end of the panel. The third pan dam portion 38 is of lesser width than the upturned panel end edge and its free end is flared outwardly from the panel end edge to facilitate snapping of the pan dam into place.

The pan dam functions to further ensure water tightness by deflecting downwardly any wind-driven rain or sleet which tends to be driven upwardly across the panel surface. Preferably the joint between the end of the pan dam and the topmost end of the panel flange 22 is closed with a mastic sealant or caulking compound, preferably a silicone based product.

The roof is completed by a cap, indicated generally at 40, installed along the ridge line of the structure to be roofed before installation of the roofing panels. Roof cap 40 is formed of metal and includes a pair of aprons 41 extending downward from a common fold line 42 and conforming generally to the pitch of the roof surface and spaced upwardly therefrom. On opposite sides the roof cap includes a longitudinal integral channel of generally rectangular cross-section extending inward from the edges of the aprons 41 and having a top wall 43, bottom wall 44, and back wall 45. The bottom channel wall 45 is wider than the top wall 43 to provide a nailing flange for attachment of the ridge cap to the roof surface. The width of channel back wall 44 is approximately equal to the combined thickness of each pan dam and top panel portion so that, when the top end of each roofing panel is inserted into the channel of the roof cap it is engaged in a snug fit.

In the assembly of a roof, the roof cap is first nailed in place. The panels and cleat caps 26 are cut to appropriate length. The topmost ends of the panels are upturned, the ends of the panel flanges are turned in, and the pan dam 35 is snapped into place. The sealant 39 is applied. A plurality of clips 10 are spaced apart longitudinally along the prospective seam line and are nailed onto the underlying supporting roof structure. One roofing panel is put into place along one side of clips 10 with the upper structure including the pan dam 35 being pushed into the channel of the roof cap 40. Then one of the angularly contoured members 14 or 15 is bent down and over the panel flange as appropriate. The next adjacent panel is similarly put into place and secured by bending the other of the contoured members down and over the flange of that next adjacent panel. The cleat cap 26 is put into place, with its upper end being pushed into the channel of the roof cap. This procedure is repeated until the roof is complete.

Figure 9:
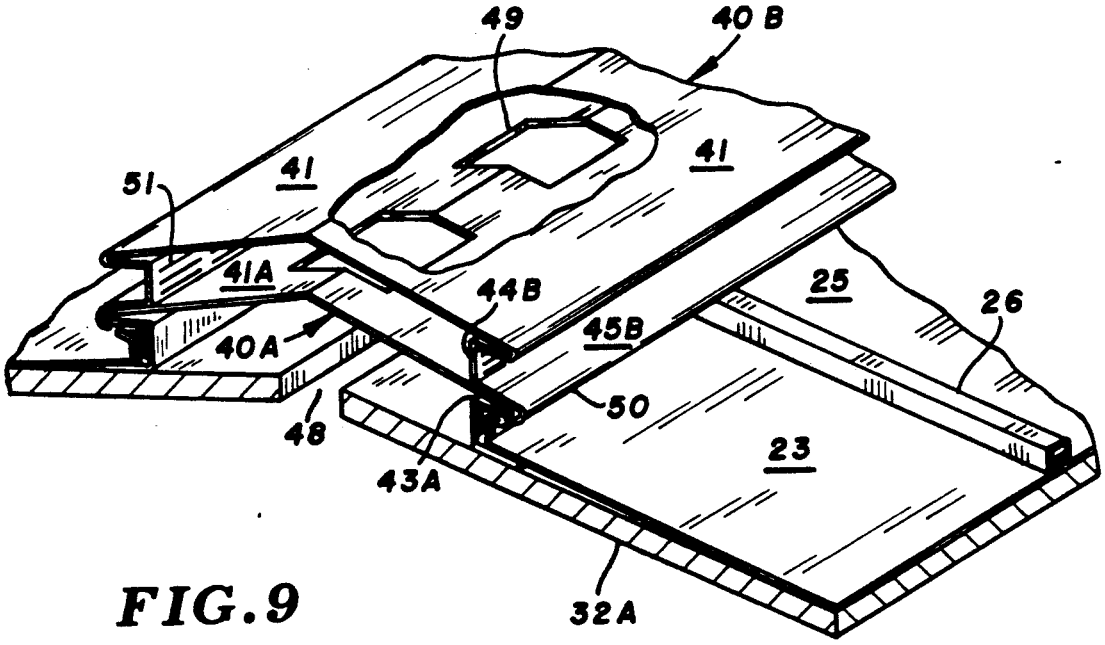
FIG. 9 is a fragmentary sectional view of a roofing system on a structure having provision for venting along the ridge line.

Some structures, such as animal barns for example, are desirably provided with air vents along the ridge of the roof. In order to provide for continued ventilation, while maintaining the water tightness of the roof, a modified system is provided, as shown in FIG. 9. The roof sheathing 32A has vent means of some sort here shown as a slot 48 running along the ridge line. The panel structure, including pan dam 35, is as previously described. A first roof cap 40A is installed. Roof cap 42A is similar in all respects to roof cap 40 except for the provision of a plurality of vent holes 49 spaced longitudinally along the roof cap. A second roof cap 40B is installed over roof cap 40A. Roof cap 40B is similar to roof cap 40 except for two material differences. The outside edge of bottom wall 35B of the longitudinal channel is bent downwardly and inwardly to form a lip 50 which is engageable with the edge of roof cap 40A at the edge juncture between the apron 41A and the top channel wall 43A of the roof cap 40A. The resiliency of the sheet metal roof cap 40B is such that it is readily snapped in place with lips 50 engaging the opposite sides of the underlying roof cap 40A. Then, to provide for continuing ventilation, a series of vent holes, preferably in the form of slits 51 are provided in the channel back wall 44B. This modified roofing system is secure and water-tight, while permitting venting of the building on which it is installed.

It is apparent that many modifications and variations of this invention as hereinbefore set forth may be made without departing from the spirit and scope thereof. The specific embodiments described are given by way of example only. The invention is limited only by the terms of the appended claims.

I claim:

1. A clip for use in installing standing seam paneling which comprises:

A. a generally rectangular upright body section,

B. a flange-like foot section integral with and extending outwardly from the bottom edge of the body section, C. at least one hole in said foot section to permit fastening of the clip to an underlying support surface, D. a pair of slightly spaced apart angularly contoured members integral with the top edge of the body section, said members having:

1) a first section coextensive with the body section, 2) a second section extending angularly outward and upward from the first section on opposite sides of the body section, and 3) a third section extending angularly upward from the second section, and E. a row of perforations adjacent to the top edge of the body section to facilitate bending of the contoured members in opposite directions on opposite sides of the body section.

2. A clip according to claim 1 wherein an indent is provided at each end of said row of perforations, the concave side of said indent being in the direction of bending of the contoured members.

3. A clip according to claim 1 wherein:

A. the second section of the contoured member extends angularly outward and upward from the first section thereof at an angle between about 40° and 50° relative thereto, and B. the third section of said member extends angularly upward from the second section thereof at an angle between about 10° and 20° relative thereto.

4. A standing seam paneling system comprising:

A. a plurality of elongated flat panels arrayed in side-by-side relation on a supporting surface, each of said panels having upturned side edges, B. a plurality of longitudinally aligned clips according to claim 1 fastened to said supporting surface and disposed between each adjacent pair of panels, between the upturned edges thereof, 1) one of the angularly contoured members of said clip being bent in one direction down and over the upturned edge of one panel, and 2) the other of said members being bent in the opposite direction down and over the upturned edge of the next adjacent panel, C. an elongated cleat cap disposed over said members and upturned panel edges, 1) said cleat cap being generally U-shaped, open at one end with generally parallel side walls, 2) the edges of said cleat cap side walls being inturned and in engagement with the third sections of the clip contoured members, and 3) a strip of resilient sealing material in the closed end of the cleat cap compressed against the tops of said clips and upturned panel edges.

5. A system according to claim 4 wherein:

A. the uppermost end edges of said panels are turned upwardly from the panel face, B. the uppermost ends of the upturned panel side edges are bent inwardly against the outer faces of the upturned end edges, and C. an elongated pan dam is disposed over and in clamping engagement with the upturned panel end edges and inwardly bent ends of the upturned panel side edges, 1) the length of said pan dam being approximately equal to the width of the panel between its upturned side edges, 2) said pan dam comprising:

a) a first portion approximately equal in length and width to the upturned panel end edges and in engagement with one face thereof, b) a second portion projecting outwardly in the direction of the flat panel surface from the top edge of said first pan dam portion, and c) a third portion extending downwardly from the inward edge of the second portion in engagement with the opposite face of the upturned panel end edges and inwardly bent ends of the upturned panel side edges.

6. A system according to claim 5 wherein the width of said third pan dam portion is less than the width of the upturned panel end edges and the edge of said third portion is flared outwardly from the panel end edges.

7. A system according to claim 5 wherein a mastic sealing material is applied over the junctures between the ends of the pan dam and the upturned panel side walls.

8. A system according to claim 5 wherein:

A. said supporting surface is a sloping gable roof surface,

B. an elongated roof cap is installed along the ridge of said roof, said cap comprising:

1) a pair of aprons extending downward from a common fold line, conforming generally to the pitch of the roof surface and spaced therefrom, and 2) a generally rectangular integral channel extending inward from the edges of said aprons, said channel having top, bottom and back walls, and C. said pan dams and uppermost ends of said panels and cleat caps are held in engagement in said channels against the back walls thereof.

9. A system according to claim 8 wherein the bottom wall of said channel is wider than said top wall to provide a nailing flange.

10. A system according to claim 8 wherein:

A. said supporting surface is a sloping gable roof surface having air vents along the ridge of the roof, B. said roof cap is provided with a plurality of spaced air vents along its length, C. a second elongated roof cap is installed along the ridge of the roof on top of said first named roof cap, said second roof cap comprising:

1) a pair of aprons extending downward from a common fold line, conforming generally to the pitch of the aprons of said first named roof cap and spaced therefrom, 2) a generally rectangular integral channel extending inward from the edges of said apron, said channel having top, bottom and back walls, 3) an inturned lip along the edge of said bottom channel wall, said lip being engageable with the juncture of the apron edge and top channel wall of said first named roof cap, and 4) a plurality of air vents in the back wall of the channel.

* * * * *